US006102975A

United States Patent [19]

Marr

[11] Patent Number: 6,102,975

[45] Date of Patent: Aug. 15, 2000

[54] FUEL CONDITIONER AND IMPROVER COMPOSITIONS

[76] Inventor: Wesley D. Marr, Marr Incorporated, LLC, 3198 Hwy. 16, Beach, N. Dak. 58621

[21] Appl. No.: 09/410,746

[22] Filed: Oct. 1, 1999

[51] Int. Cl.[7] ..... C10L 1/14; C10L 1/18; C10L 1/22

[52] U.S. Cl. ..... 44/385; 44/419; 44/437

[58] Field of Search ..... 44/385, 419, 437, 44/438

[56] References Cited

U.S. PATENT DOCUMENTS

| | | | |
|---|---|---|---|
| 2,394,978 | 2/1946 | Brandon . | |
| 2,410,846 | 11/1946 | Walters . | |
| 2,676,094 | 4/1954 | Denison et al. . | |
| 2,834,664 | 5/1958 | Irish et al. . | |
| 3,541,723 | 11/1970 | Eckert | 44/385 |
| 3,544,466 | 12/1970 | McDowell et al. | 44/419 |
| 3,557,232 | 1/1971 | Starnes, Jr. . | |
| 3,582,295 | 6/1971 | Balash | 44/419 |
| 3,822,119 | 7/1974 | Frech et al. . | |
| 3,959,381 | 5/1976 | Arkell et al. . | |
| 4,010,206 | 3/1977 | Mikami et al. . | |
| 4,565,547 | 1/1986 | Takada et al. | 44/385 |
| 4,737,159 | 4/1988 | Phillips | 44/419 |
| 4,743,273 | 5/1988 | Croudaceetal | 44/437 |
| 5,385,588 | 1/1995 | Brennan et al. . | |
| 5,522,905 | 6/1996 | Krutzsch et al. . | |

*Primary Examiner*—Margaret Medley
*Attorney, Agent, or Firm*—Richard C. Litman

[57] ABSTRACT

Fuel conditioner and improver compositions for (1) diesel fuel for medium speed diesel engines and (2) gasoline, diesel fuel, liquified petroleum gas (LPG), and liquified natural gas (LNG).

18 Claims, No Drawings

FUEL CONDITIONER AND IMPROVER COMPOSITIONS

BACKGROUND OF THE INVENTION

1. Field of the Invention

The present invention relates generally to fuel conditioner and improver compositions for (1) diesel fuel for medium speed diesel engines and (2) gasoline, diesel fuel, liquified petroleum gas (LPG), and liquified natural gas (LNG).

2. Description of the Related Art

The relevant art of interest describes various fuel additive compositions, but none discloses the specific medium speed engine diesel fuel composition and the generic composition for various combustion engines.

The relevant art will be discussed in the order of perceived relevance to the present invention.

U.S. Pat. No. 5,522,905 issued on Jun. 4, 1996, to Bernd Krutzsch et al. describes a method for adding diesel fuel containing an additive which improves the combustion of soot. The composition includes alkali metal salts, e.g., lithium, sodium and/or potassium, of either an aliphatic alcohol, an aromatic alcohol, a phenol, an aliphatic carboxylic acid, a naphthoic acid, a phenylacetic acid, or cinnamic acid. The combining proportion of the metal salt is 0.1–50 millimole of alkali metal to a liter of diesel fuel. The composition is distinguishable for a diesel fuel additive containing alkali metal salts.

U.S. Pat. No. 2,676,094 issued on Apr. 20, 1954, to George H. Denison, Jr. et al. describes an anti-knocking airplane fuel additive consisting of either p-tertiary-butylphenol or p-ethylphenol in the amount of 0.25–3.0 wt. %. The additive is distinguishable for adding only p-cresols.

U.S. Patent No. 5,385,588 issued on Jan. 31, 1995, to Timothy J. Brennan et al. describes an addition to a fuel additive containing a detergent and dispersant to improve its shelf life. The liquid composition contains (1) aromatic hydrocarbons such as benzene, toluene, ethylbenzene, xylene, mesitylene, xylene, and naphtha, and (2) alkyl or cycloalkyl alcohol such as ethanol, 2-ethylhexanol, etc. The fuel additive composition is distinguishable for its limitation to improving the shelf-life of the fuel additive and not the quality of a fuel.

U.S. Pat. No. 3,557,232 issued on Jan. 19, 1971, to William H. Starnes, Jr. describes an autoxidation inhibiting composition containing phenols and chlorinated triarylmethyl chlorides for adding to organic products containing metal ions. The composition is distinguishable for its use of chlorinated organic compounds in gasoline for removing metal ions which are not present in the present invention.

U.S. Pat. No. 3,959,381 issued on May 25, 1976, to alfred Arkell et al. describes a method of producing phenol and cyclohexanone by contacting cyclohexylbenzene with oxygen in the presence of cumene or cumene hydroperoxide to form an intermediate, and treating the intermediate with an acid cleavage catalyst in the presence of an alkanone. The products have not been disclosed as suitable fuel additives.

U.S. Pat. No. 4,010,206 issued on Mar. 1, 1977, to Ichiro Mikami et al. describes a method of producing cyclohexanone and an alkyl-substituted or unsubstituted alcohol in one step by oxidizing a liquid alkyl-substituted or unsubstituted phenylcyclohexane with molecular oxygen in the presence of hydrogen bromide. There is no suggestion for utilizing these products for fuel additives.

U.S. Pat. No. 2,834,664 issued on May 13, 1958, to Glenn Irish et al. describes a gasoline fuel containing strontium salts of organic compounds such as carboxylic acids, alcoholates, and chelates. The strontium salt additive is distinguishable because the present invention does not contain strontium.

U.S. Pat. No. 2,410,846 issued on Nov. 12, 1946, to Ernest L. Walters describes a gasoline having an improved oxidation stability and knock rating by adding 2,4-dimethyl-6-tertiary butyl phenol, either xylidine, toluidine or aniline and tetra-alkyl lead. The additive composition is distinguishable for adding an organic lead salt which is no longer environmentally acceptable.

U.S. Pat. No. 2,394,978 issued on Feb. 19, 1946, to Richard C. Brandon describes a gasoline with minimal gum formation during storage by adding cracked phenols. The cracked phenols additive is distinguishable for it is only one of multiple additives added to the fuel conditioner and improver composition of the present invention.

None of the above inventions and patents, taken either singularly or in combination, is seen to describe the instant invention as claimed. Thus, a fuel conditioner composition for either a medium speed diesel engine or a universal fuel conditioner composition is desired.

SUMMARY OF THE INVENTION

Specific and generic fuel conditioner and improver compositions are disclosed respectively for adding to (1) a diesel fuel for medium speed diesel engines and (2) gasoline, diesel fuel, liquified petroleum gas (LPG), and liquified natural gas (LNG).

Accordingly, it is a principal object of the invention to provide a specific multi-functional fuel conditioner and improver additive composition for medium speed diesel engines.

It is another object of the invention to provide a generic multi-functional fuel conditioner and improver additive composition for gasoline, diesel fuel, liquified petroleum gas, and liquified natural gas.

It is a further object of the invention to provide a fuel conditioner and improver additive composition which will maximize combustion efficiency, improve fuel stability, improve fuel injector cleanliness, and improve fuel economy for lower operating cost.

Still another object of the invention is to provide a fuel conditioner and improver additive composition which will increase lubricity for reduced engine wear, improve corrosion protection, improve anti-sludge performance, and minimize water tolerance.

It is an object of the invention to provide improved elements and arrangements thereof for the purposes described which is inexpensive, dependable and fully effective in accomplishing its intended purposes.

These and other objects of the present invention will become readily apparent upon further review of the following specification.

DETAILED DESCRIPTION OF THE PREFERRED EMBODIMENTS

The present invention is directed to a universal liquid fuel improver and a specific diesel fuel conditioner. When considering the operation of a combustion engine, it is common knowledge that the fuel injection spray pattern is critical for optimized and economical combustion of the fuel and air mixture. Nonuniform spray patterns hinder combustion and increase emissions of smoke and unburned fuel, resulting in reduced fuel efficiency and an increase of environmental pollutants. During routine combustion, fuel related deposits will form on fuel injectors, throttle bodies, carburetors, valves, and in pintle and nozzle passages. These carbonaceous deposits affect the fuel injector's proper timing and cause disruptive spray patterns and dribble. Another serious problem includes a restricted fuel flow by causing an internal passage blockage.

The compositions of the instant invention contain effective detergent and dispersant chemicals which reduce the formation of fuel injector deposits, and help to maintain maximum combustion efficiency. It has been shown that the additive compositions have improved fuel injection flow rates. Another quality which is improved by adding these compositions is fuel stability during storage due to the process of auto-oxidation and chemical reactions between unsaturated hydrocarbons and other organic compounds present in the fuel to form soluble and insoluble gums, particulate matter and agglomerated sediment. Storage tanks condense atmospheric water vapor which emulsifies the fossil fuel causing corrosion and sludge in the storage tanks.

The universal fuel improver composition PF599 is suitable for use in diesel fuels, gasoline, liquified petroleum gas, and liquified natural gas. The major ingredient in terms of volume % is medium aliphatic solvent naphtha as a carrier in the amount of 21–31% with 26% preferred. Unleaded gasoline, 2-butanol (mixing agent) and cyclohexanone are each present in the amount of 11–15% (13% preferred). Lesser amounts of 9–10% petroleum distillate (9.4% preferred) as a mixing agent, 6–7% ethyl phenol (6.4% preferred) as a detergent for carbon, 5–6% xylenol (5.4% preferred), 4–6% hydroxyethylated aminoethylamide (5.1% preferred) as a mixing agent, 4–6% heavy petroleum naphtha (3% preferred) as a carrier to start the mixing process, 4–6% alkenylcarboxylic acid (3% preferred) as a solvent enabling agent, and 0.5–1.5% naphthalene (1% preferred) as a volatility agent are added.

The final group of additives are added in minimal but effective amounts. 0.1–0.5% alkyl phenol (0.3% preferred) as an anti-oxidant agent, 0.22–0.3% meta-cresol (0.26% preferred) for lubrication and preventing emulsification and inert particle formation, 0.7–1.1% ethylbenzene (0.9% preferred), para-cresol 0.10–0.14% (0.12% preferred) for the same purpose as the meta-cresol, and 0.10–0.14% 2,4-dimethylphenol (0.12% preferred) as a anti-bacterial agent.

This additive can be added to gasoline and the like fuels in the amount of 0.1% by volume, e.g., a gallon of PF599 additive per 1,000 gallons of fuel.

Turning to a second embodiment of a specific fuel conditioner for medium speed diesel engines, PF700, lacks any gasoline and varies mostly in the increase of the medium aliphatic solvent naphtha from 34–44% with 39% preferred. The 2-butanol is increased to 17–23% with 20% preferred. The cyclohexanone is reduced slightly to 8–12% with 10% preferred. The petroleum distillate quantity remains the same at 9–10% with 9.4% preferred. The ethyl phenol has been decreased to 4.0–5.0% with 4.5% preferred. The xylenol has been decreased to 3.4–4.2% with 3.8% preferred, 4–6% hydroxyethylated aminoethylamide has been increased slightly to 5.2% preferred. The quantities of heavy petroleum naphtha and the alkenylcarboxylic acid have the same range of 2–4% with 3.1% preferred for each. The quantities of naphthalene and the alkyl phenols remain the same, respectively, at 0.5–1.5% with 1% preferred and 0.1–0.5% with 0.3% preferred. The quantities of meta-cresol (0.1–0.3% with 0.2% preferred), ethylbenzene (0.1–0.3% with 0.2% preferred), para-cresol (0.08–0.12% with 0.1% preferred), and 2,4-dimethylphenol (0.08–0.12% with 0.1% preferred) being decreased slightly. The additive is added in the same proportion to diesel fuel for medium speed engines at approximately 0.1% by volume.

These multi-functional fuel additives will result in improved vehicular drivability, economy in less fuel consumed, reduced engine noise, and extended engine component life in addition to the aforementioned storage advantages.

It is to be understood that the present invention is not limited to the embodiments described above, but encompasses any and all embodiments within the scope of the following claims.

I claim:

1. A universal fuel conditioner and improver composition with ingredients in volume % for addition to diesel fuel, gasoline, liquified petroleum gas, and liquified natural gas comprising:

21–31% medium aliphatic solvent naphtha,

11–15% unleaded gasoline,

11–15% 2-butanol,

11–15% cyclohexanone,

9–10% petroleum distillate,

6–7% ethyl phenol,

5–6% xylenol,

4–6% hydroxyethylated aminoethylamide,

4–6% heavy petroleum naphtha,

4–6% alkenylcarboxylic acid, 0.5–1.5% naphthalene, and less than 1% of each of an alkyl phenol excluding ethyl phenol, meta-cresol, para-cresol, ethylbenzene, and 2,4-dimethylphenol.

2. The universal fuel conditioner and improver composition according to claim 1, wherein 26% medium aliphatic solvent naphtha and 13% unleaded gasoline are present.

3. The universal fuel conditioner and improver composition according to claim 1, wherein 13% each of 2-butanol and cyclohexanone are added.

4. The universal fuel conditioner and improver composition according to claim 1, wherein 9.4% petroleum distillate and 6.45% of ethyl phenol are present.

5. The universal fuel conditioner and improver composition according to claim 1, wherein 5.4% xylenol and 5.1% hydroxyethylated aminoethylamide are present.

6. The universal fuel conditioner and improver composition according to claim 1, wherein 3% each of heavy petroleum naphtha and the alkenylcarboxylic acid is present.

7. The universal fuel conditioner and improver composition according to claim 1, wherein 1% of naphthalene and 0.3% of an alkyl phenol excluding ethyl phenol and 2,4-dimethylphenol are present.

8. The universal fuel conditioner and improver composition according to claim 1, wherein 0.26% of meta-cresol and 0.9% of ethylbenzene are present.

9. The universal fuel conditioner and improver composition according to claim 1, wherein 0.12% each of para-cresol and 2,4-dimethylphenol are present.

10. A diesel fuel conditioner and improver composition with ingredients in volume % for addition to diesel fuel for medium speed diesel engines comprising:

34–44% medium aliphatic solvent naphtha,

17–23% 2-butanol,

8–12% cyclohexanone,

9–10% petroleum distillate,

6–7% ethyl phenol, 3.4–4.2% xylenol, 5.2% hydroxyethylated aminoethylamide,

2–4% heavy petroleum naphtha,

2–4% alkenylcarboxylic acid, 0.5–1.5% naphthalene, and less than 1% of each of an alkyl phenol excluding ethyl phenol, meta-cresol, para-cresol, ethylbenzene, and 2,4-dimethylphenol.

11. The diesel fuel conditioner and improver composition according to claim 10, wherein 39% of medium aliphatic solvent naphtha and 20% of 2-butanol are present.

12. The diesel fuel conditioner and improver composition according to claim 10, wherein 10% cyclohexanone and 9.4% petroleum distillate are present.

13. The diesel fuel conditioner and improver composition according to claim 10, wherein 4.5% ethyl phenol and 3.8% xylenol are present.

14. The diesel fuel conditioner and improver composition according to claim 10, wherein 3.1% heavy petroleum naphtha is present.

15. The diesel fuel conditioner and improver composition according to claim 10, wherein 3.1% alkenylcarboxylic acid and 1% naphthalene are present.

16. The diesel fuel conditioner and improver composition according to claim 10, wherein 0.3% alkyl phenol excluding ethyl phenol and 2,4-dimethylphenol, and 0.2% meta-cresol are present.

17. The diesel fuel conditioner and improver composition according to claim 10, wherein 0.2% ethylbenzene and 0.1% para-cresol are present.

18. The diesel fuel conditioner and improver composition according to claim 10, wherein 0.1% of 2,4-dimethylphenol is present.

* * * * *